US008007322B2

(12) United States Patent
Okuyama et al.

(10) Patent No.: US 8,007,322 B2
(45) Date of Patent: Aug. 30, 2011

(54) CONNECTOR COMPONENT AND CONNECTOR DEVICE

(75) Inventors: Takeshi Okuyama, Shinagawa (JP); Satoshi Moriyama, Shinagawa (JP); Kiyoshi Sato, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/829,458

(22) Filed: Jul. 2, 2010

(65) Prior Publication Data

US 2011/0009010 A1 Jan. 13, 2011

(30) Foreign Application Priority Data

Jul. 10, 2009 (JP) ..... 2009-164114

(51) Int. Cl.
*H01R 24/00* (2011.01)
*H01R 33/00* (2006.01)

(52) U.S. Cl. ..... 439/660; 439/607.08; 439/733.1

(58) Field of Classification Search ..... 439/660, 439/733.1, 607.05, 607.08
See application file for complete search history.

(56) References Cited

U.S. PATENT DOCUMENTS

| | | | | |
|---|---|---|---|---|
| 5,961,355 | A | 10/1999 | Morlion et al. | |
| 6,439,928 | B1 * | 8/2002 | Akama et al. | 439/607.09 |
| 6,663,428 | B1 * | 12/2003 | Wu | 439/607.08 |
| 6,910,922 | B2 * | 6/2005 | Haga | 439/607.08 |
| 7,338,321 | B2 * | 3/2008 | Laurx | 439/607.05 |
| 7,445,502 | B2 * | 11/2008 | Zhang | 439/607.01 |
| 7,488,188 | B2 * | 2/2009 | Moriyama et al. | 439/108 |
| 7,604,510 | B2 * | 10/2009 | Akama et al. | 439/637 |
| 7,775,839 | B1 * | 8/2010 | Okuyama et al. | 439/733.1 |

FOREIGN PATENT DOCUMENTS

JP 11-250996 9/1999

* cited by examiner

*Primary Examiner* — Hae Moon Hyeon
(74) *Attorney, Agent, or Firm* — IPUSA, PLLC

(57) ABSTRACT

A connector component formed of an insulating material includes a contact member to which a plug side contact member is fitted to establish electrical conduction between the contact member and the plug side contact member. The connector component includes a plurality of openings which are formed in the connector component to penetrate the connector component, a plurality of contacts of the plug side contact member being inserted in the plurality of openings, each opening having an I-shaped cross section.

4 Claims, 13 Drawing Sheets

CONNECTOR COMPONENT AND CONNECTOR DEVICE

BACKGROUND OF THE INVENTION

1. Field of the Invention

This invention relates to a connector component formed of an insulating material, and a connector device using a connector component formed of an insulating material.

2. Description of the Related Art

Conventionally, unbalanced transmission, which uses a voltage to earth (ground potential) to transmit a signal or balanced transmission which uses a potential difference between a pair of two equal signal lines to transmit a signal, provides the common practice of transmitting data between computers or substrates. The signals transmitted or received by unbalanced transmission are called single-ended signals, while the signals transmitted or received by balanced transmission are called differential signals.

The balanced transmission has an advantage in that the differential signals are more resistant to noise than the unbalanced transmission, and the utilization range is increasing. However, the balanced transmission requires pairs of two equal signal lines and has a problem that the cost increases. The unbalanced transmission is adopted in many cases.

Conventionally, a connector adapted to unbalanced transmission signal lines and a connector adapted to balanced transmission signal lines differ in the configuration of insertion holes to which plug pins are inserted.

FIG. 1 illustrates the configuration of a connector for unbalanced transmission according to the related art and a plug side contact member to be connected to the connector.

As illustrated in FIG. 1, in the plug side member which is connected to the connector 50 for unbalanced transmission, plug side signal contacts 56 and plug side ground contacts 57 are arranged in two rows at predetermined intervals to form two rows of contacts. These contacts are provided for transmitting signals to the jack side member. The plug side ground contacts 57 are connected to the ground potential which is shared with the jack side member.

Alternatively, the signal contacts 56 and the ground contacts 57 may be arranged to form one row of contacts. Alternatively, the signal contacts 56 and the ground contacts 57 may be arranged so that the signal contacts 56 and the ground contacts 57 are alternately arrayed in each row of contacts. The respective contacts are connected to signal lines and ground lines on the back side of the plug.

The connector 50 for unbalanced transmission includes an insulating component 51 which is used as a housing of the connector. The insulating component 51 is formed of a molding component of a synthetic resin which is dielectric. The insulating component 51 includes a plurality of openings 52 which are formed to penetrate the insulating component 51 and arranged at positions confronting the respective plug side contacts.

In the insulating component 51, jack side contacts (not illustrated) are formed inside the openings 52, and these jack side contacts are electrically connected to the plug side signal contacts 56 and the plug side ground contacts 57 when inserted in the openings 52.

When the plug is inserted in the connector 50 for unbalanced transmission, the plug side contacts and the jack side contacts are fitted together by pressure to make the electrical conduction stable.

On the other hand, FIG. 2 illustrates the configuration of a connector for balanced transmission according to the related art and a plug side contact member to be connected to the connector.

As illustrated in FIG. 2, in the plug side member which is connected to the connector 60 for balanced transmission, pairs of plug side signal contacts 66 and 67 and plug side ground contacts 68 are alternately arranged in a line at predetermined intervals. These contacts are provided for transmitting signals to the jack side member. The plug side ground contacts 68 are connected to the ground potential which is shared with the jack side member. In FIG. 2, the details of the plug side ground contacts 68 are not illustrated. Each of the plug side signal contacts 66 and 67 in FIG. 2 has a configuration similar to the configuration of the plug side signal contact 56 or the plug side ground contact 57 in FIG. 1.

Each pair of plug side signal contacts 66 and 67 are provided for transmitting a pair of two complementary signals (+signal and −signal) that are equal in magnitude and opposite in electrical potential. Alternatively, the pairs of plug side signal contacts 66 and 67 may be arranged to form one row of signal contacts similar to the case of the connector 50 for unbalanced transmission. Alternatively, the pairs of plug side signal contacts 66 and 67 may be arranged so that the signal contacts 66 and the signal contacts 67 are alternately arrayed in each row of contacts.

The connector 60 for balanced transmission includes an insulating component 61 which is used as a housing of the connector. The insulating component 61 is formed of a molding component of a synthetic resin which is dielectric. The insulating component 61 includes a plurality of openings 62, 63, and 64 which are arranged at positions confronting the respective plug side contacts. Apart from the connector 50 of FIG. 1, the openings 62, 63, and 64 of the insulating component 61 in the connector 60 of in FIG. 2 have different configurations and are adapted to the plug side contacts 66, 67, and 68 respectively. The plug side signal contacts 66 and 67 are inserted in the openings 62 and 63, and the plug side ground contact 68 is inserted in the opening 64.

In the insulating component 61, jack side contacts (not illustrated) are formed inside the openings 62, 63, and 64, and these jack side contacts are electrically connected to the plug side signal contacts 66 and 67 and the plug side ground contact 68 when inserted in the openings 62, 63, and 64.

As described in the foregoing, the connector for unbalanced transmission and the connector for balanced transmission differ in the size and arrangement of the plug side contact member, and the formation patterns of holes in the insulating components of these connectors are different from each other. For this reason, there has been a problem in that the connector components formed of the same insulating component must be manufactured with different production lines.

Japanese Laid-Open Patent Publication No. 11-250996 discloses a receptacle (connector) in which different signal contacts and ground contacts of the same insulating component are arranged (see FIGS. 11 and 12).

However, the connector disclosed in Japanese Laid-Open Patent Publication No. 11-250996 can be adapted only to a plug with a special configuration and the general versatility of this connector is low. If this connector is used for parallel transmission (see FIG. 12), ground contacts do not exist at several positions between different pairs of signal contacts and the electromagnetic shielding is inadequate. Therefore, this connector does not offer convenience to customers, and application of this connector for both the unbalanced transmission and the balanced transmission is difficult.

SUMMARY OF THE INVENTION

In one aspect of the invention, the present disclosure provides a connector component which is highly convenient and suitably applicable for both an unbalanced transmission connector and a balanced transmission connector.

In an embodiment of the invention which solves or reduces one or more of the above-mentioned problems, the present disclosure provides a connector component formed of an insulating material, the connector component including: a jack side contact member to which a plug side contact member is fitted to establish electrical conduction between the jack side contact member and the plug side contact member; and a plurality of openings which are formed in the connector component to penetrate the connector component, a plurality of contacts of the plug side contact member being inserted in the plurality of openings, each opening having an I-shaped cross section.

In an embodiment of the invention which solves or reduces one or more of the above-mentioned problems, the present disclosure provides a connector device including: the above-mentioned connector component; and the plug side contact member fitted to the jack side contact member of the connector component to establish electrical conduction between the jack side contact member and the plug side contact member.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the drawings.

Figure 1:
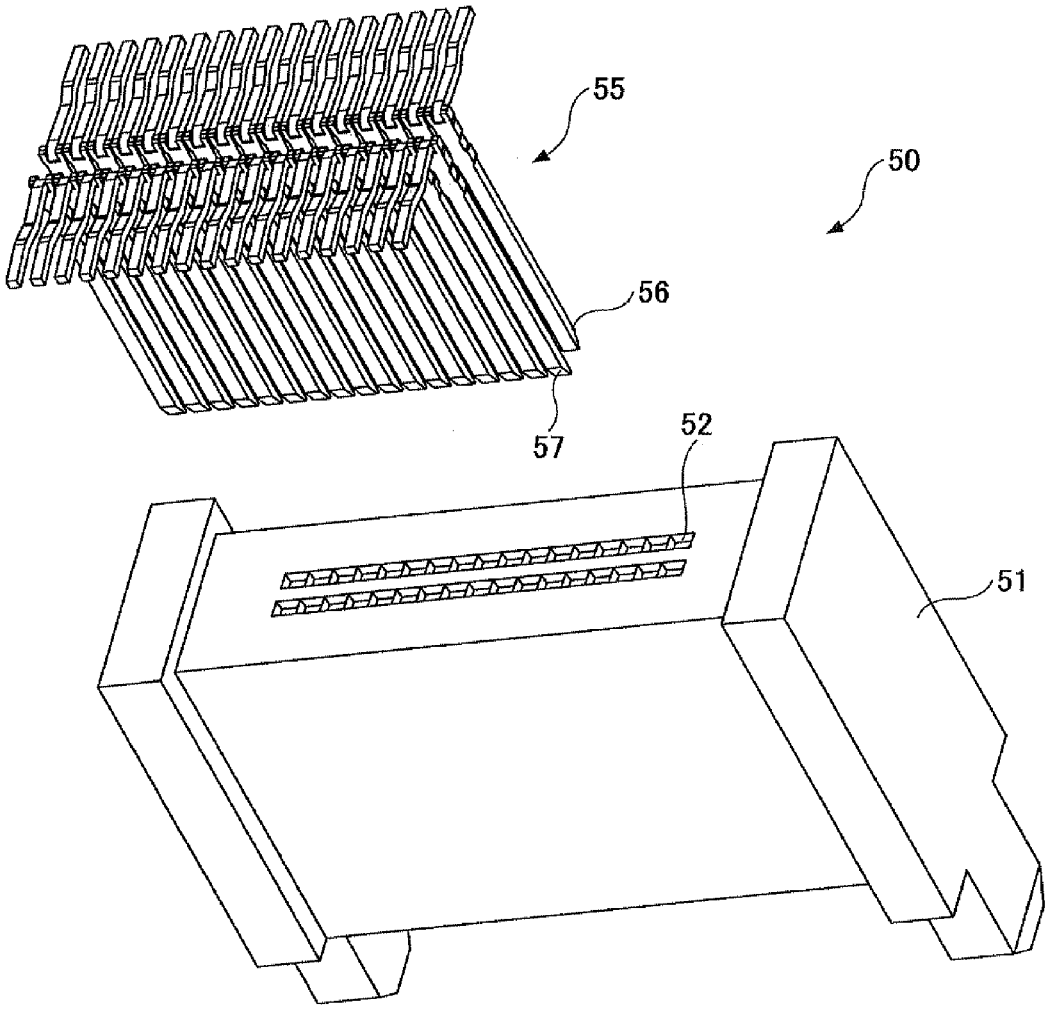
FIG.1 RELATED ART
FIG. 1 is a diagram illustrating the configuration of a connector for unbalanced transmission according to the related art and a plug side contact to be connected to the connector.
Figure 2:
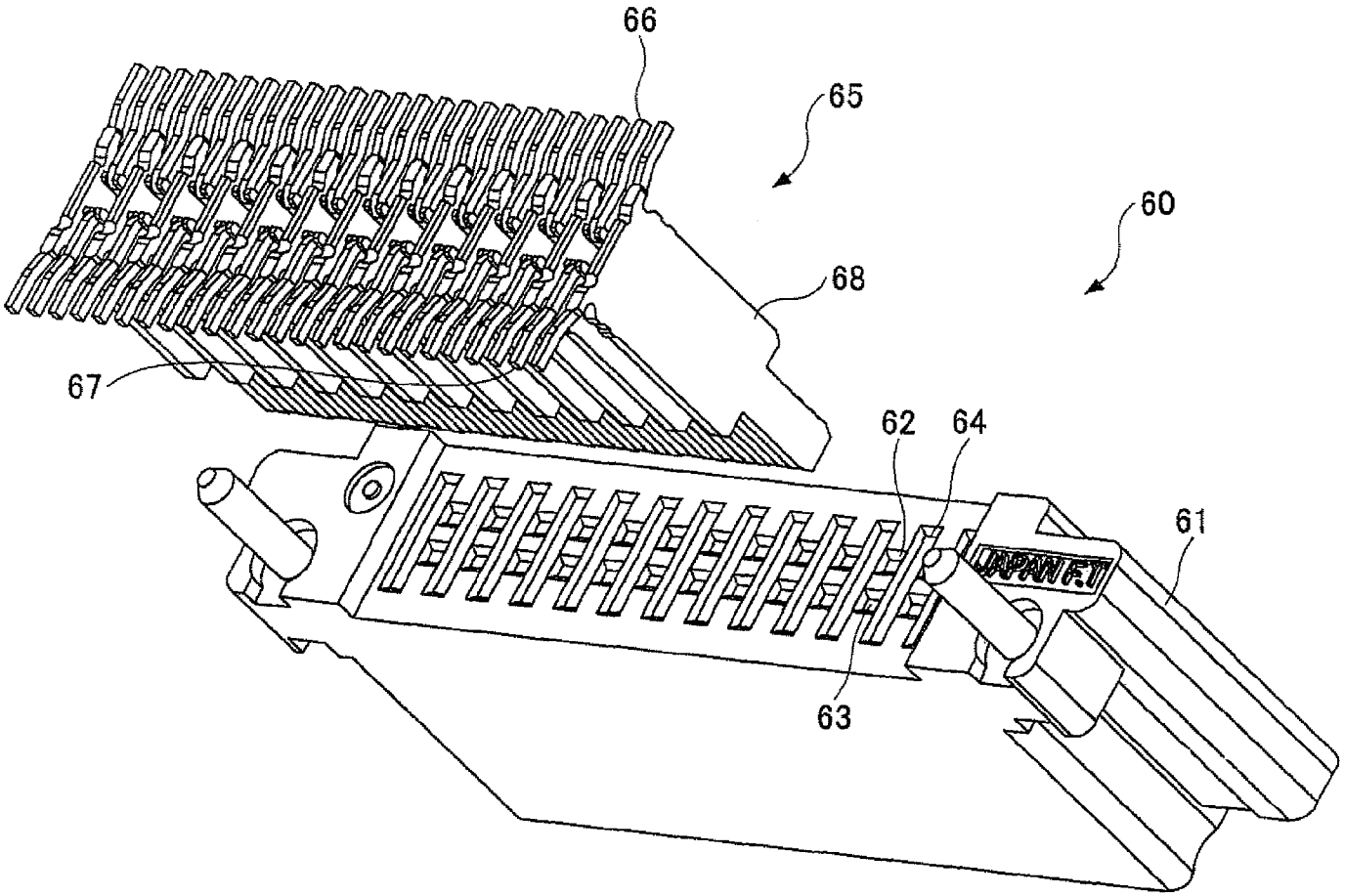
FIG.2 RELATED ART
FIG. 2 is a diagram illustrating the configuration of a connector for balanced transmission according to the related art and a plug side contact to be connected to the connector.
Figure 3:
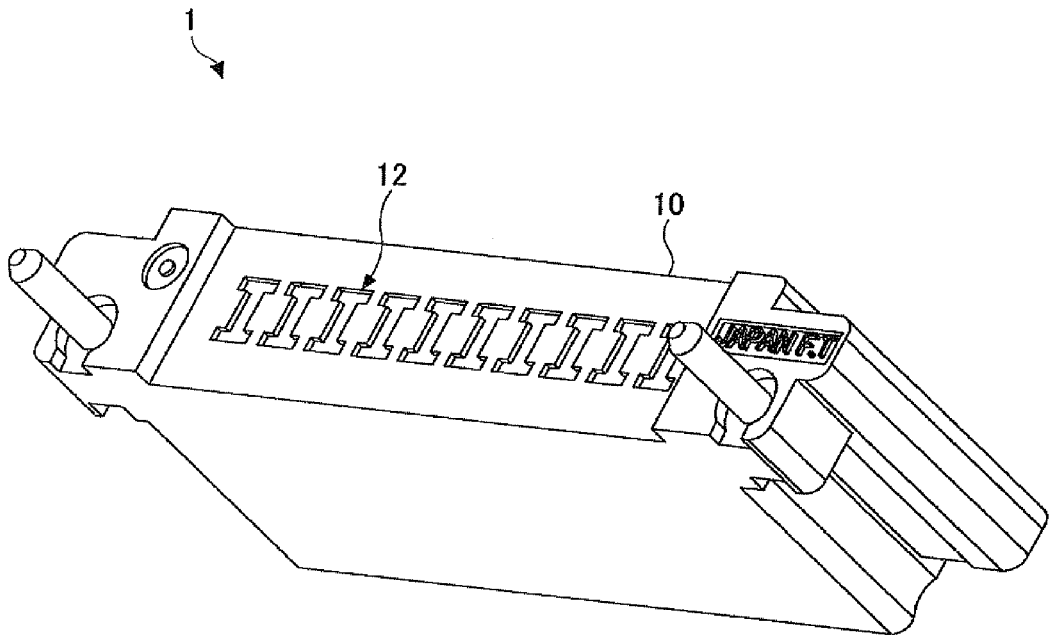
FIG. 3 is a diagram illustrating the configuration of a connector device containing an insulating component of an embodiment of the present disclosure.

A connector device including an insulating component of an embodiment of the present disclosure will be described. FIG. 3 illustrates the configuration of a connector device 1 including an insulating component 10 of the present embodiment. The insulating component 10 is used as a housing of the connector device 1 and equivalent to a connector component in the claims.

For example, the connector device 1 is mounted on a surface of a substrate, and a plug (not illustrated) connected to one end of a transmission line is inserted to the connector device 1, so that the substrate is electrically connected to an apparatus connected to the other end of the transmission line.

Alternatively, the plug may be mounted on a surface of the substrate, and the connector device 1 may be connected to one end of the transmission line. Alternatively, the plug and the connector device 1 may be connected to the ends of the transmission line.

Alternatively, the connector device 1 may be mounted on a first substrate and the plug may be mounted on a second substrate. In this case, the connector device 1 may be used to connect the first and second substrates. In this manner, the object to which the connector device 1 of this embodiment is applied is not restricted.

In FIG. 3, the insulating component 10 is used as a housing of the connector device 1. However, the connector component according to the present disclosure is not limited to this embodiment. Alternatively, the connector component may be a component with a front panel in which openings 12 are formed.

A plug which is connected to the connector device 1 will be described. This plug includes a plurality of plug side contacts which are inserted in the connector device 1.

(A) A description will be given of a case in which the connector device 1 of this embodiment is a connector for unbalanced transmission. In this case, a plurality of sets of plug side contacts are formed and arrayed at predetermined intervals.

These plug side contacts include pairs of the plug side signal contact and the plug side ground contact. These plug side contacts are formed of a conductive metallic material. The end of each plug side contact, opposite to the end connected to the connector device 1, is connected to an internal substrate, and this internal substrate is connected to a high-speed transmission line (or another substrate).

When a high-speed transmission line is connected to the internal substrate, this high-speed transmission line is, for example, a coaxial line. In the coaxial line, a core of copper (which turns into a signal line), a shielding line of braided wires, an insulator of a resin, and a protective layer of a resin are sequentially laminated one by one from the central axis.

The core of the transmission line is connected to the plug side signal contact, and the shielding line is connected to the plug side signal ground contact.

(B) A description will be given of a case in which the connector device 1 of this embodiment is a connector for balanced transmission. In this case, a plurality of sets of plug side contacts are formed and arrayed at predetermined intervals. Each set of plug side contacts include a pair of plug side signal contacts for transmitting +signal and −signal and a plug side ground contact. The plug side signal contacts and the plug side ground contacts are alternately arrayed.

These plug side contacts are formed of a conductive metallic material. The end of each plug side contact, opposite to the end connected to the connector device 1, is connected to an internal substrate, and the internal substrate is connected to a high-speed transmission line (or another substrate).

When a high-speed transmission line is connected to the internal substrate, this high-speed transmission line is, for example, a twisted pair cable. In the twisted pair cable, a pair of copper cores (which turn into a pair of signal lines), an insulator of a resin, and a ground line are included and covered by a protective layer of a resin. The pair of cores of the twisted pair cable are connected to a pair of plug side signal contacts, and the ground line of the twisted pair cable is connected to the plug side signal ground contact.

Next, the composition of the connector device 1 of this embodiment will be described. The insulating component 10 is formed of a molding component of a synthetic resin that is dielectric (for example, a thermoplastic resin, such as LCP (liquid crystal polymer)). The insulating component 10 includes a plurality of openings 12 which are formed to penetrate the insulating component 10 and arranged at positions confronting the respective plug side contacts (not illustrated).

Insertion holes into which fixing screws (not illustrated) used to mount the connector device 1 on the printed circuit board (not illustrated) are inserted are formed on the back surface of the insulating component 10. The jack side contacts are disposed inside the openings 12 of the insulating component 10, and electrical conduction between the jack side contacts and the plug side contacts is established by fitting the plug side contacts thereto by pressure. These jack side contacts are formed of a conductive metallic material, such as phosphor bronze.

Although a knife/fork fitting, a bellows fitting, etc. may be used as the mode of pressure fitting of the plug side contacts and the jack side contacts, the mode of pressure fitting of the plug side contacts and the jack side contacts according to the present disclosure is not limited. Namely, the plug side contacts having a convex configuration may be fitted to the jack side contacts having a concave configuration by pressure. Alternatively, the plug side contacts having a bellows configuration may be fitted to narrow passages by pressure such that the plug side contacts and the jack side contacts are fitted together.

The jack side contacts are connected at one end to the plug side contacts by the pressure fitting described above, and connected at the other end the printed circuit board via lead wires.

In the above composition, if the plug is connected to the connector device 1, the printed circuit board is electrically connected to an apparatus (or another substrate in which the plug is mounted) which is connected to one end of the transmission line to which the plug is connected.

Next, the composition of a plurality of openings 12 in which the plug side contacts are inserted and the composition of the plug side contacts will be described.

In the insulating component 10, as illustrated in FIG. 3, each opening 12 is formed to have an I-shaped cross section, and the plurality of openings 12 are arrayed at predetermined intervals in the longitudinal direction of the insulating component 10. Each opening 12 is formed with tapered portions near its entrance port at which chamfering is conducted, so that the plug side contact can be easily inserted into the opening 12.

Figure 4:
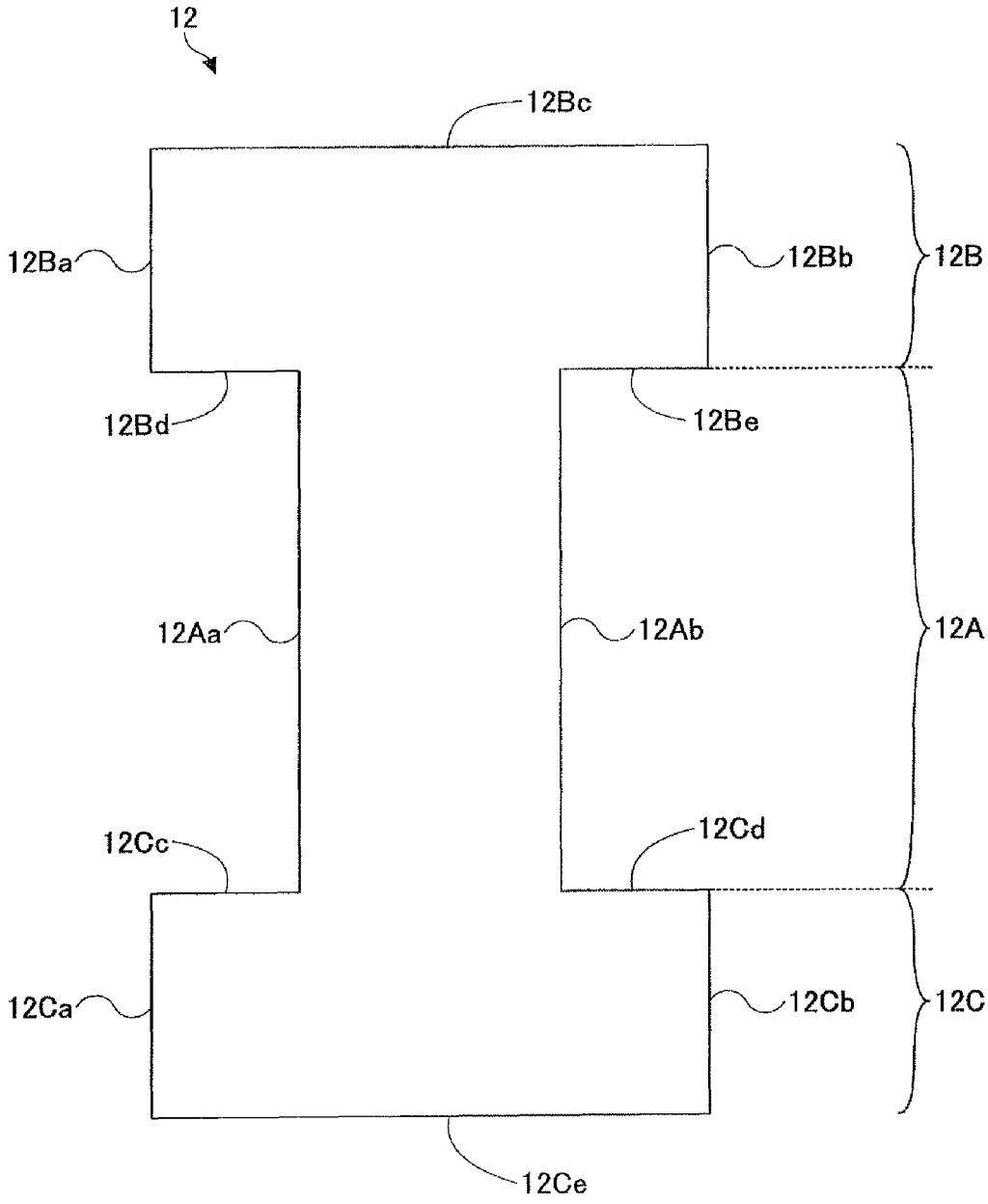
FIG. 4 is a diagram illustrating the configuration of one of a plurality of openings included in the insulating component of one embodiment of the present disclosure.

FIG. 4 illustrates the configuration of one of a plurality of openings 12 in the insulating component 10 of one embodiment of the present disclosure. As illustrated in FIG. 4, each opening 12 includes a first rectangular part 12A which forms a central portion of the I-shaped opening, and a second rectangular part 12B and a third rectangular part 12C which form both end portions of the I-shaped opening. These rectangular parts 12A, 12B and 12C communicate with each other.

As compared with the second rectangular part 12B and the third rectangular part 12C, the first rectangular part 12A has a slightly large size and is suitable for receiving a jack side ground contact when the connector device 1 is used as a balanced transmission connector.

On the other hand, as compared with the first rectangular part 12A, the size of each of the second rectangular part 12B and the third rectangular part 12C is slightly small. These rectangular parts 12B and 12C are suitable for receiving a pair of jack side signal contacts when the connector device 1 is used as a balanced transmission connector or suitable for receiving a pair of the jack side signal contact and the jack side ground contact when the connector device 1 is used as an unbalanced transmission connector.

Accordingly, the plurality of openings 12 in the insulating component 10 of this embodiment are arranged to have a configuration which can be suitably adapted to both the unbalanced transmission connector and the balanced transmission connector.

(A) When the connector device 1 is used as a connector for unbalanced transmission, the plural pairs of the plug side signal contacts and the plug side ground contacts are formed in the plug side connector which is fitted to the connector device 1. In this case, the plug side signal contacts and the plug side ground contacts have the same configuration.

Figure 5:
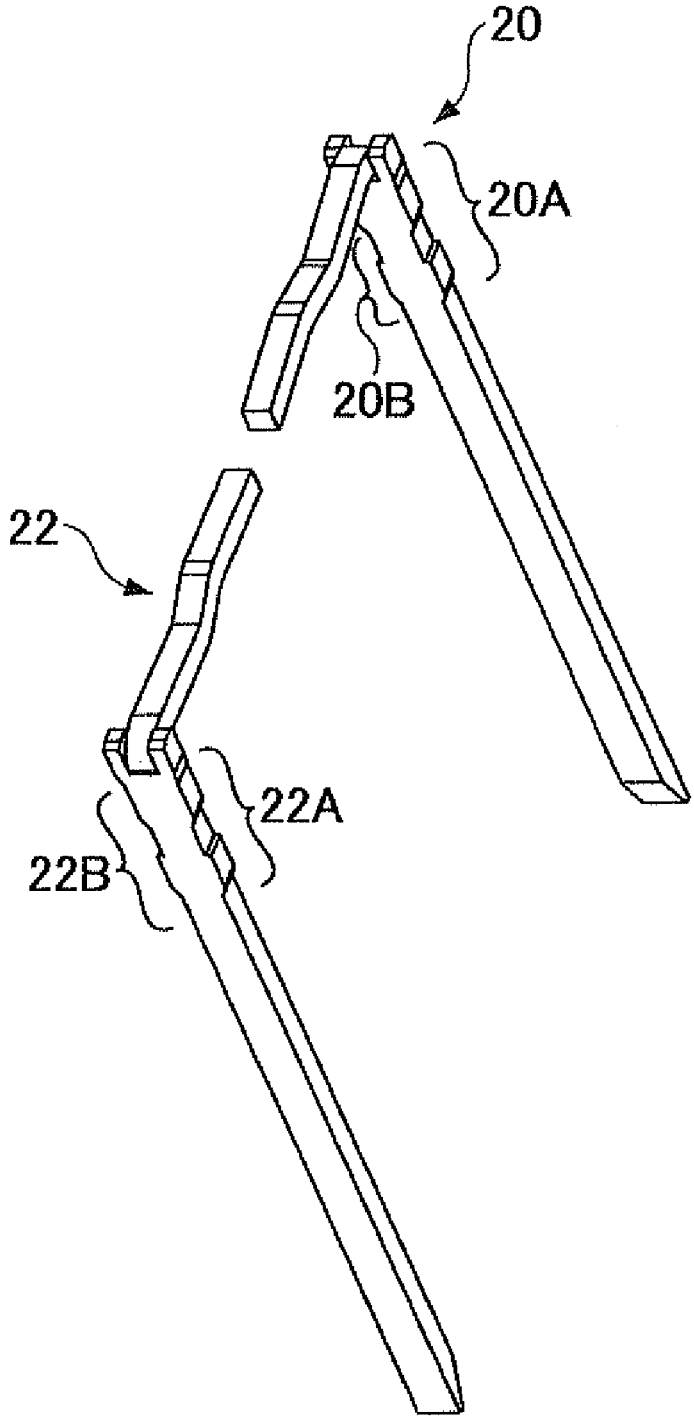
FIG. 5 is a diagram illustrating the configuration of a pair of a plug side signal contact and a plug side ground contact.

FIG. 5 illustrates the configuration of a pair of a plug side signal contact and a plug side ground contact. In FIG. 5, the plug side signal contact 20 is illustrated at the upper right side, and the plug side ground contact 22 is illustrated at the lower left side. In this case, the plug side signal contact 20 is inserted into and fitted to the second rectangular part 12B of the I-shaped opening 12.

If the plug side signal contact 20 is fitted to the second rectangular part 12B up to near the bottom end by pressure, the holder parts 20A and 20B formed on the right and left sides of the plug side signal contact 20 are brought in contact with the right and left ends 12Ba and 12Bb of the second rectangular part 12B (in this case, the longitudinal direction of the connector device 1 is the lateral direction), respectively. Hence, the plug side signal contact 20 and the connector device 1 can be fixed to each other along the direction in which the plug side signal contact 20 is inserted.

If the plug side signal contact 20 is held by the right and left ends 12Ba and 12Bb of the second rectangular part 12B, displacement of the plug side signal contact 20 in the longitudinal direction of the connector device 1 is restricted. If the plug side signal contact 20 is held by the top end 12Bc and the bottom ends 12Bd and 12Be of the second rectangular part 12B, displacement of the plug side signal contact 20 in the lateral direction of the connector device 1 is restricted.

Similarly, the plug side ground contact 22 is inserted into and fitted to the third rectangular part 12C. If the plug side ground contact 22 is fitted to the third rectangular part 12C up to near the bottom end, the holder parts 22A and 22B formed on the right and left sides of the plug side ground contact 22 are brought in contact with the right and left ends 12Ca and 12Cb of the third rectangular part 12C, respectively. Hence, the plug side ground contact 22 and the connector device 1 can be fixed to each other along the direction in which the plug side ground contact 22 is inserted.

If the plug side ground contact 22 is held by the right and left ends 12Ca and 12Cb of the third rectangular part 12C, displacement of the plug side ground contact 22 in the longitudinal direction of the connector device 1 is restricted. If the plug side ground contact 22 is held by the third top ends 12Cc and 12Cd and the bottom end 12Ce of the rectangular part 12C, displacement of the plug side ground contact 22 in the lateral direction of the connector device 1 is restricted.

Accordingly, after the plug side signal contacts are inserted into the openings 12 and the plug is connected to the connector device 1, it is possible to prevent the plug side signal contacts from being disconnected from the connector device 1 due to vibrations applied to the connector device 1, which may cause a problem, such as a poor connection.

Figure 6:
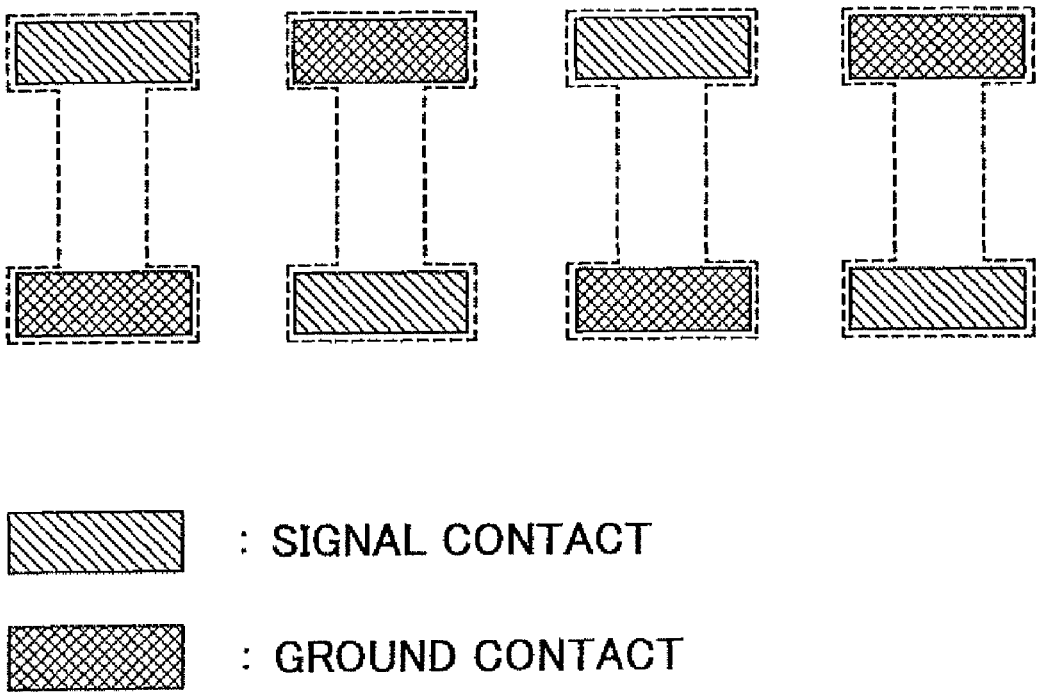
FIG. 6 is a diagram illustrating an arrangement pattern of rows of contacts formed inside second rectangular parts and third rectangular parts.

FIG. 6 illustrates an arrangement pattern of rows of contacts formed inside the second rectangular parts 12B and the third rectangular parts 12C of the plurality of openings 12. As illustrated in FIG. 6, the plurality of openings 12 of the insulating component 10 (connector component) are arranged so that, in each row of contacts, the jack side signal contacts and the jack side ground contacts are alternately arrayed.

(B) When the connector device 1 is used as a connector for balanced transmission, the plural sets each including a pair of the plug side signal contacts and the plug side ground contact are formed in the plug side connector which is fitted to the connector device 1.

More specifically, each pair of the plug side signal contacts and the plug side ground contact are alternately arrayed in the longitudinal direction of the connector device 1. In this case, the plug side signal contacts of each pair have the same configuration.

Figure 7:
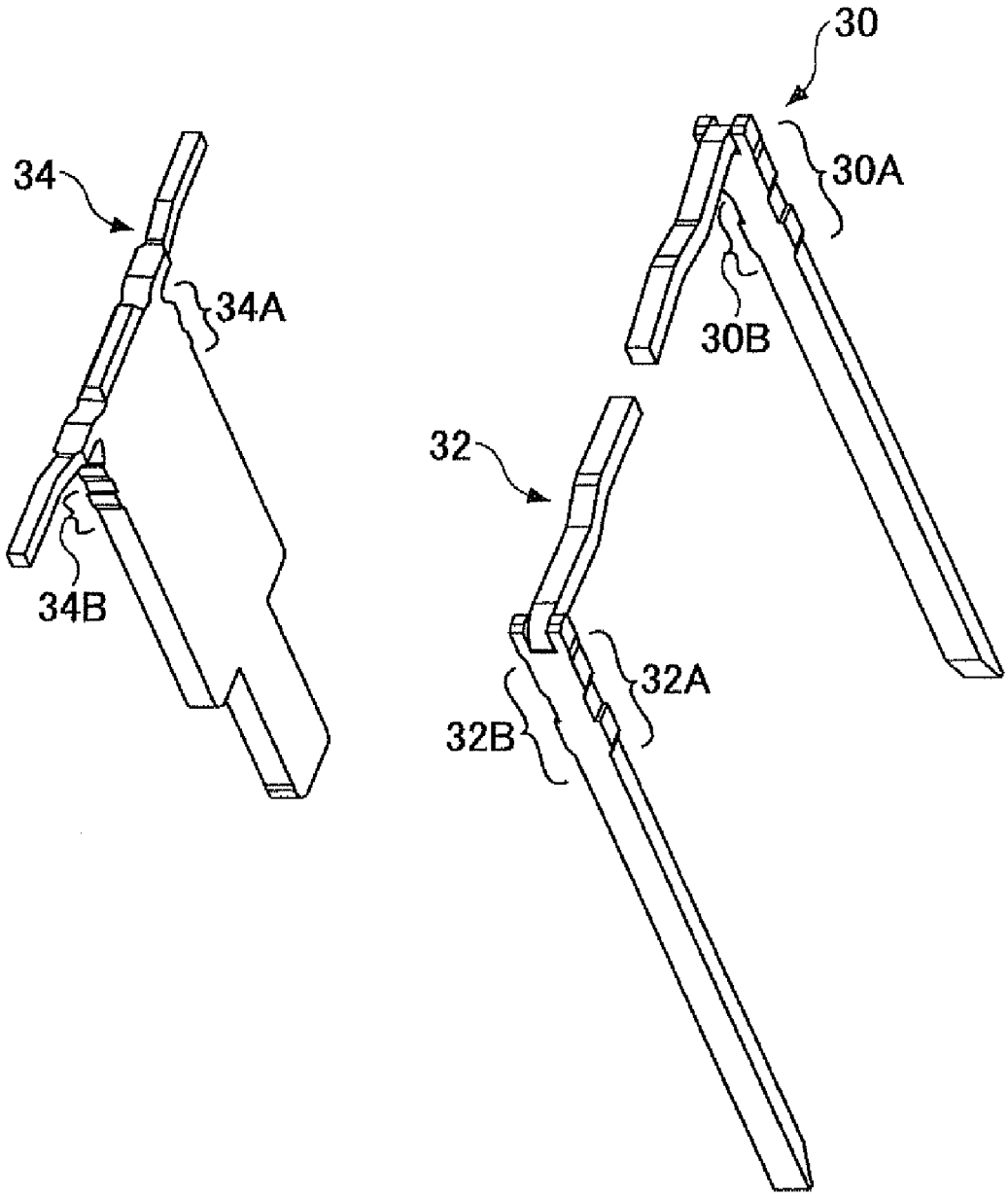
FIG. 7 is a diagram illustrating the configuration of a pair of plug side signal contacts and a plug side ground contact.

FIG. 7 illustrates the configuration of a pair of plug side signal contacts 30 and 32, and a plug side ground contact 34. The plug side signal contacts 30 and 32 are for transmitting the +signal on one side and transmitting the −signal on the other side. The plug side ground contact 34 is formed to be larger in size than the plug side signal contacts 30 and 32, in order to provide adequate electromagnetic shielding in between the neighboring pairs of signal contacts 30 and 32.

The plug side signal contact 30 is inserted into and fitted to the second rectangular part 12B. The plug side signal contact 32 is inserted into and fitted to the third rectangular part 12C. The plug side signal contact 30 includes holder parts 30A and 30B, the plug side signal contact 32 includes holder parts 32A and 32B, and displacement of the plug side signal contacts 30 and 32 to the connector device 1 in both the vertical and lateral directions is restricted similar to the case (A) above in which the connector device 1 is used as a connector for unbalanced transmission. Therefore, it is possible to prevent the plug side signal contacts from being disconnected from the connector device 1 due to vibrations applied to the connector device 1, which may cause a problem, such as a poor connection.

The plug side ground contact 34 is inserted into and fitted to a rectangular region that extends from the central portion of the second rectangular part 12B to the central portion of the third rectangular part 12C through the first rectangular part 12A.

If the plug side ground contact 34 is fitted to the above rectangular region up to near the bottom end, the holder parts 34A and 34B formed on the right and left sides of the plug side ground contact 34 are brought in contact with the top end 12Bc of the second rectangular part 12B and the bottom end 12Ce of the third rectangular part 12C, respectively. Hence, the plug side ground contact 34 and the connector device 1 can be fixed to each other along the direction in which the plug side ground contact 34 is inserted.

If the plug side ground contact 34 is held by the right and left ends 12Aa and 12Ab of the first rectangular part 12A, displacement of the plug side ground contact 34 in the longitudinal direction of the connector device 1 is restricted. If the plug side ground contact 34 is held by the top end 12Bc of the second rectangular part 12B and the bottom end 12Ce of the third rectangular part 12C, displacement of the plug side ground contact 34 in the lateral direction of the connector device 1 is restricted.

Accordingly, after the plug side signal contacts are inserted into the openings 12 and the plug is connected to the connector device 1, it is possible to prevent the plug side signal contacts from being disconnected from the connector device 1 due to vibrations applied to the connector device 1, which may cause a problem, such as causing a poor connection.

Figure 8:
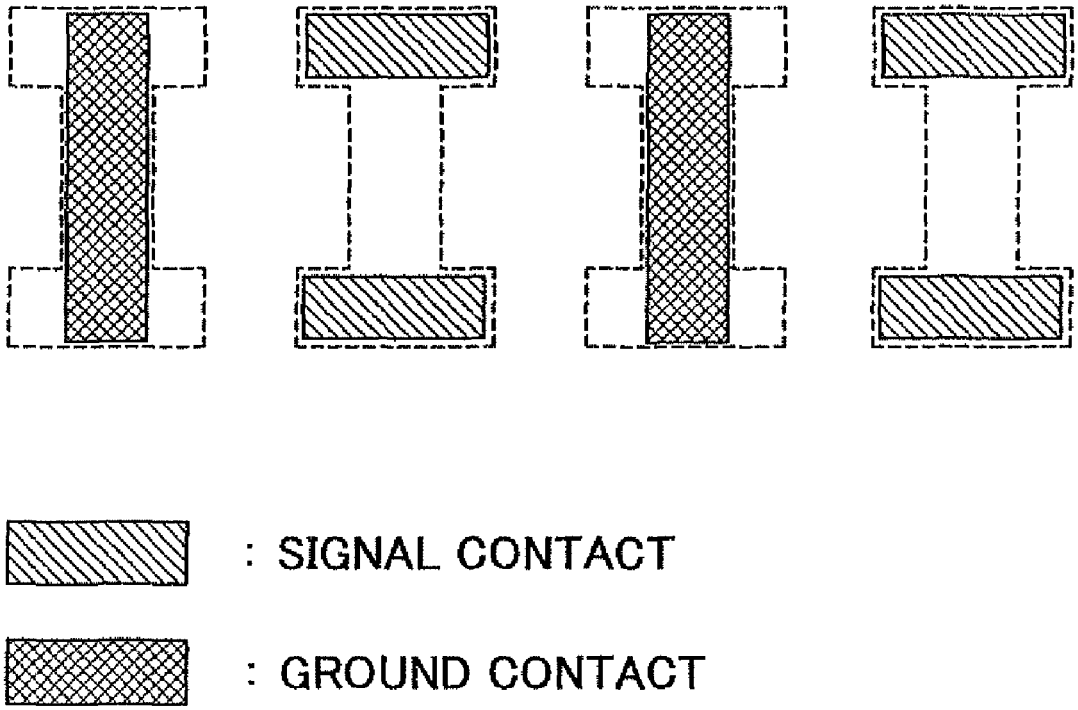
FIG. 8 is a diagram illustrating an arrangement pattern of rows of contacts formed inside the plurality of openings.

FIG. 8 illustrates an arrangement pattern of rows of contacts formed inside the rectangular parts of the plurality of openings 12. As illustrated in FIG. 8, the plurality of openings 12 of the insulating component 10 (connector component) are arranged so that, in the rows of contacts, the jack side signal contacts (the +signal and the −signal) and the jack side ground contacts are alternately arrayed. In FIG. 8, the differences between the jack side signal contacts for transmitting the +signal and the jack side signal contacts for transmitting the −signal are not illustrated. As illustrated in FIG. 8, each of the plug side ground contacts vertically extends from the top end 12Bc of the second rectangular part 12B to the bottom end 12Ce of the third rectangular part 12C. The arrangement pattern provides adequate electromagnetic shielding in between the neighboring pairs of signal contacts.

As described above, the insulating component 10 of this embodiment has the advantageous configuration of the openings 12 that is suitably applicable to both the connector for unbalanced transmission and the connector for balanced transmission. The insulating component 10 of this embodiment can be suitably adapted to a slender-shaped plug and is highly convenient. Accordingly, it is no longer necessary to manufacture the insulating components for unbalanced transmission connectors and the insulating components for balanced transmission connectors separately because of different opening configurations, and the manufacturing cost of connectors can be reduced.

Moreover, the connector device 1 including the insulating component 10 of this embodiment can restrict displacement with the plug, can prevent occurrence of a problem, such as a poor connection, and can stably maintain electric conduction between the connector device 1 and the plug.

Furthermore, when the connector device 1 is used a connector for balanced transmission, the plug side ground contacts are inserted into the longest parts of the I-shaped openings of the insulating component 10, and the connector device 1 including the insulating component 10 of this embodiment can provide adequate electromagnetic shielding in between the neighboring pairs of signal contacts.

Next, the arrangement of holding a cable with respect to the connector device 1 will be described. Suppose that the connector device 1 of this embodiment is a connector for balanced transmission and a twisted pair cable is connected to a plug. In the following, the arrangement of holding the cable on the side of the plug will be described. However, the same arrangement may be applicable to the side of the connector device 1 where the cable is connected to the connector device 1.

In the present arrangement, pairs of cores used as signal lines are held by a holder member 70 so that the pairs of cores are arrayed in the vertical position in the longitudinal direction of the plug, wherein the direction of each core pair is perpendicular to the longitudinal direction of the plug.

Figure 9:
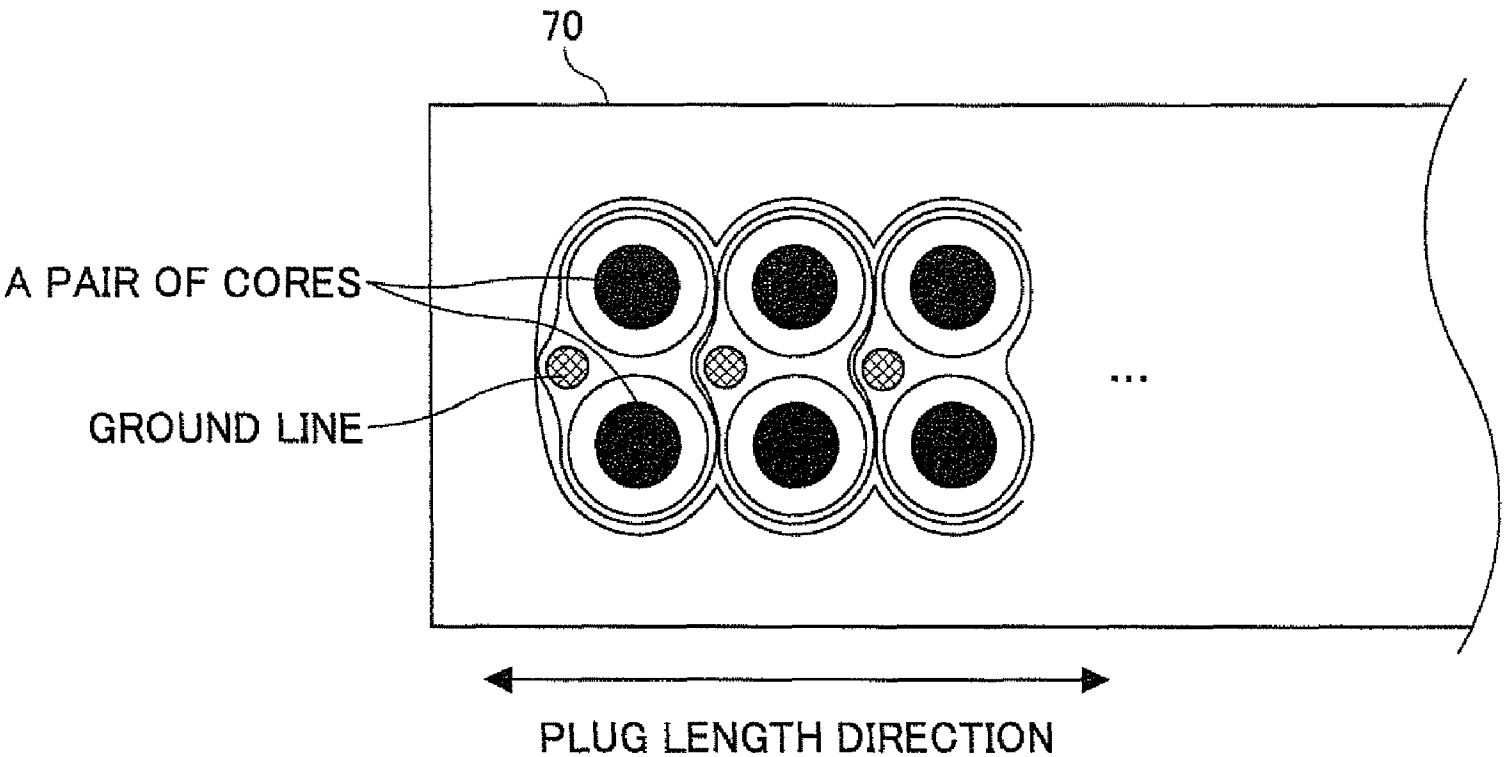
FIG. 9 is a diagram for explaining the condition in which pairs of cores as signal lines are held by a holder member so that the pairs of cores are arrayed in the vertical position in the longitudinal direction of the plug.

FIG. 9 illustrates the above-described condition of the pairs of cores in the holder member 70. As illustrated in the FIG. 9, the holder member 70 holds the pairs of cores without separating the pairs of cores completely.

Figure 10:
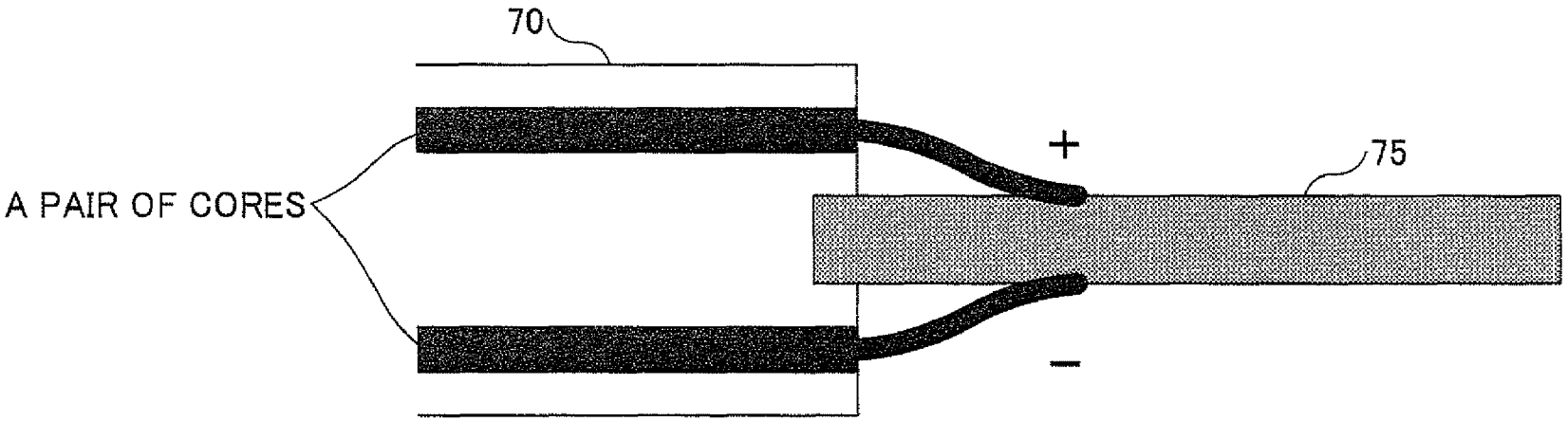
FIG. 10 is a diagram for explaining the condition in which a pair of cores are connected to a top surface and a bottom surface of an internal substrate respectively.

The holder member 70 and an internal substrate 75 are fixed together such that the internal substrate 75 is located between each pair of cores, and the cores of each pair are connected to a top surface and a bottom surface of the internal substrate, respectively. FIG. 10 illustrates the above-described condition of a pair of cores in the holder member 70.

Using the above-described arrangement, the length of a transmission path for transmitting the +signal and the length of a transmission path for transmitting the −signal can be made equal, and the electrical characteristics of these transmission paths can be made equal.

The above-described arrangement has been used for the plug. Alternatively, the following arrangement may be used instead.

The lengths of a plug and a connector in the longitudinal direction are defined according to the standard requirements. Plugs or connectors having an excessively large length in the longitudinal direction may not be used. Therefore, when the arrangements as in FIGS. 9 and 10 are used, there is a restriction in increasing the signal density.

When the pairs of cores are held without separating the pairs of cores as illustrated in FIG. 9, the arrangement in the cable holder may fluctuate due to a certain external force applied to the cable holder.

Alternatively, another arrangement in the cable holder may be applied to the plug as follows. In such an alternative arrangement, pairs of cores used as signal lines are held by a holder member 80 so that the pairs of cores are arrayed in the lateral position in the longitudinal direction of the plug, wherein the direction of each core pair is parallel to the longitudinal direction of the plug.

Figure 11:
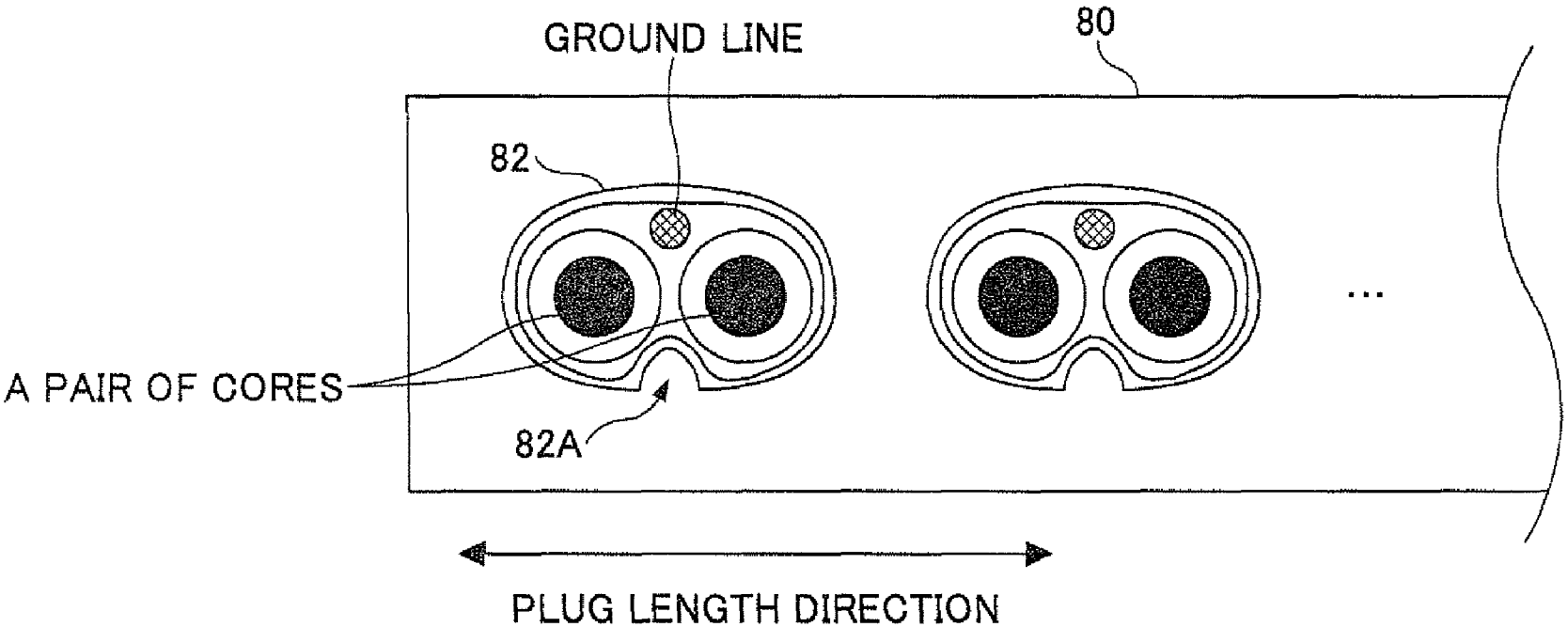
FIG. 11 is a diagram for explaining the condition in which pairs of cores as signal lines are held by a holder member so that the pairs of cores are arrayed in the lateral position in the longitudinal direction of the plug.
Figure 12:
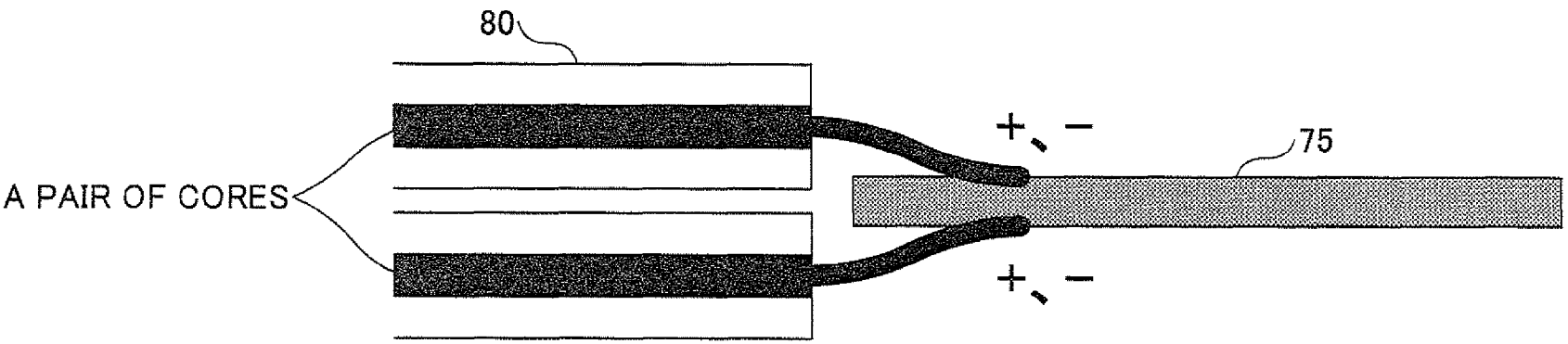
FIG. 12 is a diagram for explaining the condition in which a plurality of holder members that are laminated and a pair of cores are connected to a top surface and a bottom surface of an internal substrate respectively.

FIG. 11 illustrates the above-described condition of the pairs of cores in the holder member 80. In this case, two or more holder members 80 may be laminated together, the cores of a pair may be connected to a top surface of the internal substrate 75 and the cores of another pair may be connected to a bottom surface of the internal substrate 75. FIG. 12 illustrates the above-described condition of the holder members 80 and the internal substrate 75. The above arrangement in which the cores of one pair are connected to one surface of the internal substrate 75 may increase the design versatility of the internal substrate 75.

The above arrangement in which the two or more holder members 80 are laminated can make the spacing between adjacent pairs of cores larger than that in the arrangement of FIG. 9. Therefore, the pairs of cores can be held with separate openings 82 as illustrated in FIG. 11. Thereby, the strength of each holder member 80 can be made higher than that of the holder member 70 in the arrangement of FIG. 9.

As illustrated in FIG. 11, a projection 82A may be formed in each opening 82 of the holder member 80, and displacement of the pair of cores can be certainly restricted. It is preferred that a cross-sectional area of each opening 82 is smaller than a cross-sectional area of the cable.

Figure 13:
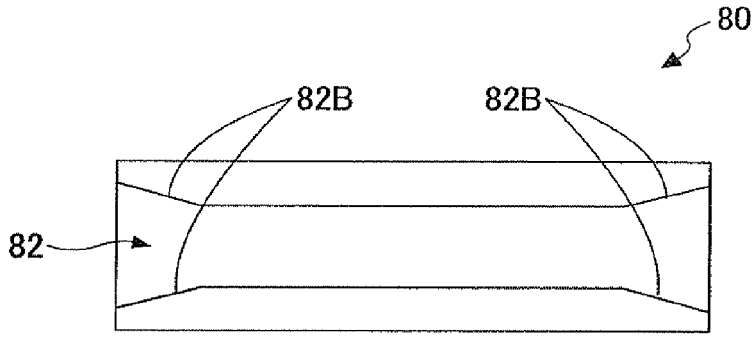
FIG. 13 is a diagram for explaining the condition in which chamfered parts are formed at the both ends of an opening of a holder member.
Figure 14:
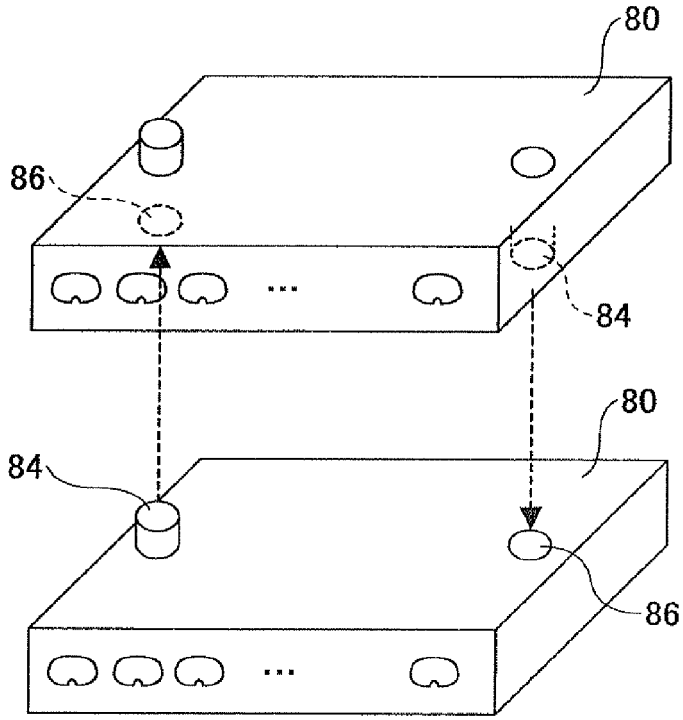
FIG. 14 is a diagram for explaining the condition in which holder members are positioned by using a lamination projection and a lamination recess when the holder members are laminated.

As illustrated in FIG. 13, it is preferred that chamfered parts 82B are formed at the both ends of the opening 82 so that a cable may be easily connected or disconnected. When the holder members 80 are laminated as illustrated in FIG. 14, it is preferred that the holder members 80 are positioned by using a lamination projection 84 and a lamination recess 86.

As described in the foregoing, according to the present disclosure, it is possible to provide a connector component which is highly convenient and suitably applicable for both an unbalanced transmission connector and a balanced transmission connector.

The present disclosure is not limited to the above-described embodiments, and variations and modifications may be made without departing from the scope of the present disclosure.

The present application is based on Japanese patent application No. 2009-164114, filed on Jul. 10, 2009, the entire contents of which are incorporated herein by reference in their entirety.

What is claimed is:

1. A connector device comprising:

an insulating component made of an insulating material;

a plurality of openings which are formed in the insulating component to penetrate the insulating component, each of the plurality of openings having an I-shaped cross section, and the plurality of openings including a plurality of jack side contacts disposed inside the plurality of openings respectively; and a plug side contact member including a plurality of plug side contacts which are inserted in the plurality of openings and fitted to the plurality of jack side contacts respectively to establish electrical conduction between the plurality of jack side contacts and the plurality of plug side contacts of the plug side contact member, wherein a jack side ground contact is disposed at a center portion of each of the plurality of openings having the I-shaped cross section, and jack side signal contacts are disposed at end portions of each of the plurality of openings having the I-shaped cross section.

2. The connector device according to claim 1, wherein the connector device is provided for balanced transmission.

3. A connector device comprising:

an insulating component made of an insulating material;

a plurality of openings which are formed in the insulating component to penetrate the insulating component, each of the plurality of openings having an I-shaped cross section, and the plurality of openings including a plurality of lack side contacts disposed inside the plurality of openings respectively; and a plug side contact member including a plurality of plug side contacts which are inserted in the plurality of openings and fitted to the plurality of jack side contacts respectively to establish electrical conduction between the plurality of side contacts and the plurality of plug side contacts of the plug side contact member, wherein a jack side ground contact is disposed at one of end portions of each of the plurality of openings having the I-shaped cross section, and a jack side signal contact is disposed at the other of the end portions of each of the plurality of openings having the I-shaped cross section.

4. The connector device according to claim 3, wherein the connector device is provided for unbalanced transmission.

* * * * *